United States Patent [19]

Schneider

[11] 4,293,989

[45] Oct. 13, 1981

[54] GLUE ROLLER FOR LABELLING MACHINE

[75] Inventor: Egon Schneider, Neutraubling, Fed. Rep. of Germany

[73] Assignee: Hermann Kronseder, Worth, Donau, Fed. Rep. of Germany

[21] Appl. No.: 47,501

[22] Filed: Jun. 11, 1979

[30] Foreign Application Priority Data

Jun. 10, 1978 [DE] Fed. Rep. of Germany ..... 282561

[51] Int. Cl.[3] ..... B21B 31/08

[52] U.S. Cl. ..... 29/130; 29/132; 118/DIG. 15

[58] Field of Search ..... 29/110, 130, 132; 118/DIG. 15, DIG. 14, 244, 258, 261

[56] References Cited

U.S. PATENT DOCUMENTS

| | | | |
|---|---|---|---|
| 2,638,073 | 5/1953 | Carter | 118/DIG. 15 |
| 2,926,628 | 3/1960 | Black et al. | 29/130 X |
| 3,475,803 | 11/1969 | Hill | 29/132 |
| 3,691,949 | 9/1972 | Giori et al. | 29/130 X |
| 4,050,886 | 9/1977 | Moser | 29/132 X |

FOREIGN PATENT DOCUMENTS

| | | | |
|---|---|---|---|
| 1195640 | 6/1965 | Fed. Rep. of Germany | 29/130 |
| 202261 | 4/1939 | Switzerland | 29/130 |

*Primary Examiner*—James Kee Chi

*Attorney, Agent, or Firm*—Wheeler, House, Fuller & Hohenfeldt

[57] ABSTRACT

Glue roller for use in labeling machines and the like, comprising a metal hub, a tubelike support body fixed on the hub, and an elastic sleeve with a cylindrical outer surface seated on the support body. The support body is a first moulded part of foam material having sealed boundary zones, which is foamed directly onto the hub. The elastic sleeve is a second moulded part of elastic foam material with sealed boundary zones, which is foamed directly onto the support body. The support body and elastic sleeve are provided with interengaging projections and recesses which extend parallel to the axis of the roller.

9 Claims, 3 Drawing Figures

Fig. 2
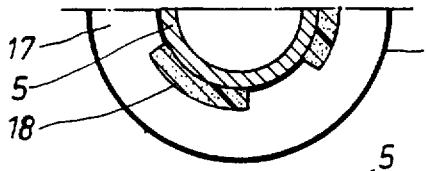
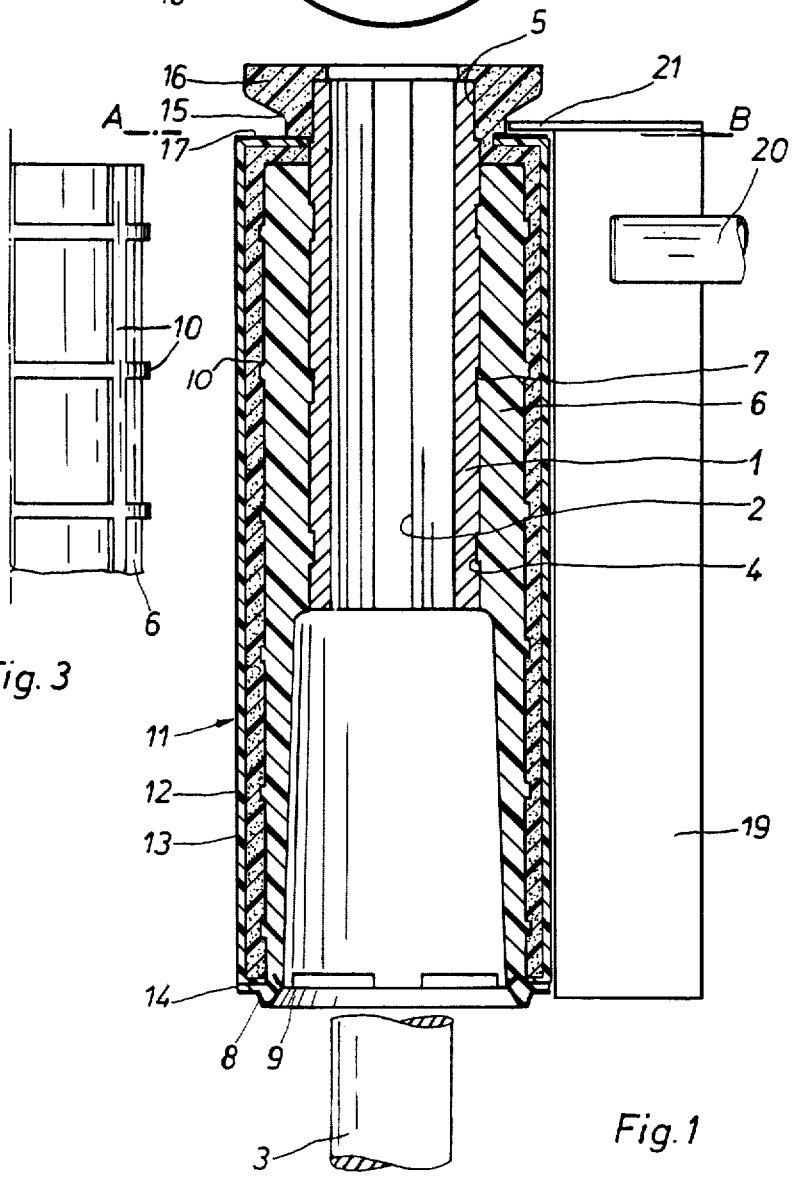
Fig. 3
Fig. 1

GLUE ROLLER FOR LABELLING MACHINE

The invention relates to a glue roller according to the preamble of claim 1.

Such glue rollers have the purpose, essential for a satisfactory functioning of labeling machines, of coating the removal element for the labels, which comprises metal, with a glue film of a predetermined thickness. After being coated, the removal element moves to pick up a label from a stack by adhesion after which the label is removed from the element and pressed onto a container such as a bottle. For this purpose, at the periphery of the glue roller there is arranged a stationary, adjustable glue doctor blade which distributes the glue, supplied through a nozzle, over the cylindrical outer surface of the elastic sleeve and regulates the thickness of the glue film. The elastic sleeve is then subject to numerous stresses in operation. By the continuous impacts and rolling of the removal element, by any impact of the glue doctor blade in the case of inexpert operation, by mechanical and thermal stress during the daily cleaning of the glue roller, especially, however, by the entry of label or metal foil remnants into the space between the glue doctor blade and the sleeve and by the removal of these remnants by means of sharp edged tools, there is produced a roughening of the sleeve surface or even a rut formation. Thereby, an uneven gluing of the removal element and a spattering of glue is caused, which necessarily leads to faults in the labeling operation. On all of these grounds, the relatively frequent replacement of the glue rollers in labeling machines can not be avoided.

In a known glue roller of the initially mentioned type, the metal hub, provided with an integral hand grip, comprises a moulded part, which is expensive to prepare and which is provided with a plurality of radial flanges for bridging a spacing between the drive shaft and the elastic sleeve, on which part the support body, which likewise comprises metal, is fixed by corrugations. The elastic sleeve seated on the support body, comprises rubber having the same structure over its entire cross-section. The production costs of this known glue roller, and consequently the replacement costs, are correspondingly high. Also, a recovering after removal of the worn sleeve, including the subsequent making ready of the new sleeve, is extremely cost intensive. In addition to this, the period of use of the known glue roller is not very high and, in unfavourable cases, amounts to only a few weeks or months.

The invention is based on the problem of providing a glue roller for labeling machines, which has a very high useful life and is also extremely inexpensive to make.

This problem is solved, in a glue roller of the first-mentioned type, by the features in the classification of claim 1.

In a glue roller made, according to the invention, in a compound manner, due to the extensive use of foam material the material and moulding costs are extremely low, as are also the assembly costs, since by the direct foaming onto one another of the individual parts, together with the toothing produced by the projections and recesses without additional work steps, an intensive connection between the individual component parts occurs, which also withstands the strong stresses by the removal element. In addition, the wear resistance and therewith the service life of the glue roller according to the invention is substantially higher than with the known glue rollers, in particular because of the sealed, friction-resistant boundary zone of the elastic sleeve. The operating costs of a labeling machine are thereby noticeably lowered by the incorporation of the glue roller according to the invention. Furthermore, the low weight of the glue roller, which considerably facilitates handling, especially during the daily cleaning, is advantageous.

A particularly high wear resistance, with advantageous manufacturing costs, is achieved if, according to a development of the invention, the elastic sleeve comprises polyurethane integral foam material. Such a foam material having a Shore hardness A of 85 has, for example, been found to be suitable.

A high strength of the glue roller is assisted when, according to another development of the invention, the support body comprises polyurethane duromer foam material. Such a foam material having a Shore hardness D of, example, 70 has a very hard, smooth and homogeneous outer layer or skin, so that on one hand a high strength and on the other hand a good cleanability are provided.

Since in a glue roller according to the invention the hub has, substantially, only the task of centering the glue roller non-rotationally on its drive shaft, while the bridging of the spacing to the elastic sleeve is effected by the support body, having a corresponding wall thickness, it can, according to a further development of the invention, comprise in an inexpensive manner a tubular piece.

A particularly reliable connection between the elastic sleeve and the support body and, possibly, between the support body and the hub is achieved, according to an advantageous development of the invention, in that corresponding surfaces of the support body and the sleeve and, possibly, the hub and the support body are provided with interengaging grooves and ribs extending in the peripheral direction and the longitudinal direction of the glue roller.

Further advantageous developments of the invention, which contribute to low manufacturing costs and a long service life, are contained in the sub-claims.

For a more detailed explanation of the invention, an exemplary embodiment is described hereinafter with reference to the drawings, in which:

FIG. 1 shows a longitudinal section through a glue roller.

FIG. 2 shows the section A B of FIG. 1.

FIG. 3 shows a partial side view of the support body of the glue roller of FIG. 1.

The glue roller according to FIGS. 1 to 3 comprises a hub 1, which is made from a metal tubular piece, e.g. from an aluminum tube. The hub 1 is provided, in its boring, with a wedge groove 2, with the help of which it is non-rotationally mounted on a vertical drive shaft 3 of a labeling machine, which is not shown in greater detail. On the periphery of the hub 1, a plurality of annular grooves 4 and, if required, longitudinal grooves, together with a reduction 5 of reduced outer diameter, are machined.

Directly on the hub 1, there is moulded or foamed a support body 6 comprising polyurethane duromer foam with a smooth, homogenous outer layer, which engages in the annular grooves 4 and, possibly, longitudinal grooves of the hub 1 by projections 7 produced during the moulding operation. By the thus-formed toothing, in cooperation with any shrinkage produced after the foaming and the adhesive force of the foam, there is effected a fixed, durable connection of the hub 1 and the support body 6. The support body 6 terminates somewhat before the reduction 5 formed at one end of the hub 1, while it projects at its other end beyond the hub. On the face of the projecting region of the support body 6, there is embedded a reinforcement ring 9 provided with a plurality of bent tabs 8. On the cylindrical outer surface of the support body 6, furthermore, ribs 10 are formed extending in the circumferential and longitudinal directions.

Directly on the support body 6, an elastic sleeve 11, comprising polyurethane integral foam with a Shore hardness A of 85, is moulded or foamed, which embraces the ribs 10 of the support body 6 by grooves 12 produced during the moulding operation. By the thus-formed toothing, in cooperation with any shrinkage produced after the foaming and the adhesive force of the foam, there is effected a fixed, durable connection of support body 6 and sleeve 11. The elastic sleeve 11 has a sealed boundary zone 13, formed during the foaming, which is represented in FIG. 1 by a closer hatching. Furthermore, the support body 6 also has a similar sealed boundary zone; with a duromer foam, however, this is not so distinct, since this foam in any case is very find pored and compact. The elastic sleeve 11 extends as far as the end of the support body 6 projecting beyond the hub 1, where its face is covered by a radial flange 14 formed on the support body or the reinforcement ring 9 integrated in the flange. At the other end, the sleeve 11, forming a contraction 15, extends around the corresponding face of the support body 6 and the part of the hub 1 projecting from the support body, including the end face thereof. An annular bulge 16 adjoins the contraction 15 of the sleeve 11, which bulge serves as a hand grip and terminates the glue roller. In the region of the contraction 15, a support ring 17 is embedded in the sleeve 11, which ring outwardly covers the corresponding radially extending shoulder of the sleeve 11. The support ring 17 is centered by means of its opening on the reduction 5 of the hub 1 and provided with a plurality of cut-outs 18, through which the sleeve 11 extends.

The glue roller cooperates in conventional manner with an adjustable glue doctor blade 19 for regulating the glue film thickness, with a glue nozzle 20 for glue supply and with a glue tray, not shown, for carrying away the excess glue. The glue doctor blade 19 is provided at its upper end with a horizontally directed wiper 21, which engages in the contraction 15 of the elastic sleeve 11 and lies opposite the protective ring 17 with a small spacing.

The method of producing the above-described glue roller can take place as follows: the prefabricated hub 1 and the prefabricated reinforcement ring 9 are laid in a first foam mould, the contour of which corresponds to the shape of the support body 6. Thereafter, the closed mould is filled with the mixed components for producing the desired polyurethane duromer foam. After the hardening of the foam, the intermediate product, comprising the hub 1, the reinforcement ring 9 and the support body 6, is laid in a second foam mould, the contour of which corresponds to the shape of the elastic sleeve 11, including the integral bulge 16. The protective ring 17 is previously fitted onto the hub 1. Thereafter, the closed second mould is filled with the mixed components for forming the desired polyurethane integral foam. After hardening of the foam, the glue roller is already substantially manufactured. It may merely be necessary to bring the sleeve surface to the exact final dimension by grinding. The method of manufacture is also the subject of the patent application.

I claim:

1. Glue roller for labeling machines, with a metal hub for rotationally fixed mounting on a drive shaft, a tube-like support body fixed on the hub and with an elastic sleeve, having a cylindrical outer surface, seated on the support body, the hub and the support body being provided with interengaging recesses and projections, characterized in that the support body (6) is formed by a first moulded part of foam material having sealed boundary zones, which is foamed directly onto the hub (1), that the elastic sleeve (11) is formed by a second moulded part of elastic foam material with sealed boundary zones (13), which is foamed directly on the support body (6), that the foam material of the support body (6) has a lower elasticity than the foam material of the sleeve (11), and that the support body (6) and the elastic sleeve (11) are provided with interengaging projections (10) and recesses (12) which extend parallel to the axis of the roller.

2. Glue roller according to claim 1, characterized in that the elastic sleeve (11) comprises polyurethane integral foam material.

3. Glue roller according to claim 1 or 2, characterized in that the support body (6) comprises polyurethane duromer foam material.

4. A glue roller assembly for use in labeling machines and the like, said roller assembly comprising:

an elongated generally cylindrical hub (1) for being rotated about its longitudinal axis, a first layer (6) of foam material having a predetermined hardness molded onto the outer surface of said hub, said first layer having an inner surface interfacing with said hub and a nonporous outer surface having axially spaced apart ends, a second layer (11) of elastic foam material having lesser hardness than said first layer molded onto said outer surface of said first layer, said second layer having an outer surface and having an inner surface interfacing with said outer surface of the first layer, said interfacing surfaces of said second layer and first layer being provided with interengaging projections (10) and recesses (12) which extend parallel to the axis of the roller.

5. The glue roller assembly as in claim 4 wherein said interfacing surfaces of said first layer and hub are provided with interengaging projections (7) and recesses (4).

6. The glue roller assembly as in claim 4 wherein:

said second layer (11) of elastic material extends radially inwardly over one of said first layer ends and further extends integrally and axially to define a portion (15) which has a reduced outside diameter in comparison with the diameter of said outer surface of said second layer and then diverges to an axially adjacent and integral portion (16) of greater diameter than said reduced diameter portion.

7. The glue roller assembly as in claim 6 including a metal reinforcing ring (17) substantially radially coextensive with said radially inwardly extending material and embedded in said reduced diameter portion where said portion begins to extend from said radially inwardly extending material.

8. The glue roller assembly as in claim 6 wherein the other of said first layer (6) ends has a radially extending flange portion (14) molded internally with said layer and which interfaces with at least a part of an adjacent end of said second layer (11).

9. The glue roller assembly as in claim 8 including a metal reinforcing ring (9) embedded in said other of said first layer (6) ends and having a radially extending portion which interfaces with said radially extending flange portion (14).

* * * * *